US006932232B2

(12) United States Patent
Watanabe et al.

(10) Patent No.: US 6,932,232 B2
(45) Date of Patent: Aug. 23, 2005

(54) RADIATOR CAP WITH PRESSURE VALVE

(75) Inventors: Kazuhiro Watanabe, Hadano (JP); Hisae Nishikawa, Hadano (JP); Takashi Nohara, Hadano (JP)

(73) Assignee: T. Rad Co., Ltd., Tokyo (JP)

( * ) Notice: Subject to any disclaimer, the term of this patent is extended or adjusted under 35 U.S.C. 154(b) by 0 days.

(21) Appl. No.: 09/998,352

(22) Filed: Nov. 30, 2001

(65) Prior Publication Data

US 2004/0040966 A1 Mar. 4, 2004

(30) Foreign Application Priority Data

Jan. 31, 2001 (JP) ..... 2001-024054

(51) Int. Cl.[7] ..... B65D 41/06
(52) U.S. Cl. ..... 220/298; 220/DIG. 33
(58) Field of Search ..... 220/298, 303, 220/306, 300, 301, 203.28, 203.26, DIG. 33, DIG. 32, 327

(56) References Cited

U.S. PATENT DOCUMENTS

| | | | | | |
|---|---|---|---|---|---|
| 1,684,412 | A | * | 9/1928 | Reiner | 220/300 |
| 3,216,608 | A | * | 11/1965 | McCormick | 220/203.24 |
| 3,700,166 | A | * | 10/1972 | Foults | 236/34.5 |
| 4,269,230 | A | * | 5/1981 | Pepper | 138/89 |
| 5,071,020 | A | * | 12/1991 | Reutter | 220/203.06 |
| 6,390,318 | B1 | * | 5/2002 | Tanaka et al. | 220/203.26 |
| 6,516,964 | B1 | * | 2/2003 | Gerhardt et al. | 220/4.14 |

FOREIGN PATENT DOCUMENTS

| | | | | |
|---|---|---|---|---|
| JP | 2000-186554 | * | 7/2000 | 220/203.28 |

* cited by examiner

*Primary Examiner*—Lien M. Ngo
(74) *Attorney, Agent, or Firm*—Jordan and Hamburg LLP

(57) ABSTRACT

A pressure valve including a valve seat 3 is mounted on a cap body 8 side. The cap body 8 and a filler neck 6 are fastened together in an anti-disengagement manner by use of locking means.

2 Claims, 7 Drawing Sheets

RADIATOR CAP WITH PRESSURE VALVE

BACKGROUND OF THE INVENTION

1. Field of the Invention

The present invention relates to a cap with pressure valve removably attached to a filler neck for supply of water which is mounted primarily on the upper end of a radiator tank for vehicles.

2. Description of the Related Art

A conventional radiator cap with pressure valve has been formed as seen in FIG. 13 and a filler neck 6 mounted removably with the cap has been formed as seen in FIG. 14.

The cap with pressure valve comprises a cap body 8 to which are attached via a fitting metal 22 a packing retainer 18 having an annular sealing material 7 and a temple-bell-shaped valve retainer 23, with a pressurization valve 10 attached via a movable plate 24 to the foot of the valve retainer 23. A negative pressure valve 11 is disposed via a valve stem 25 at the center of the pressurization valve 10. The pressurization valve 10 is urged downward by a pressure spring 9 and the negative pressure valve 11 is urged upward by a negative pressure spring 26.

The filler neck 6 is formed as a short cylinder whose bottom has an opening defined by its inner flanged portion. The opening edge of the inner flanged portion provides a valve seat 3. The upper edge of the filler neck 6 is formed with a flanged portion 19 whose outer peripheral edge hangs down to a slight extent, with a cam face 20 provided on the edge of the hung portion.

A pair of notches 21 are opposed diametrically on the flanged portion 19. The notches receive a pair of locking claws 17 formed on the underside of the cap body 8 such that the locking claws 17 are firmly engaged with the cam face 20 by turning the cap body 8 whereby the cap body 8 is removably fastened to the filler neck 6.

The filler neck 6 is provided with a small-diameter pipe 1. The lower end opening of the filler neck 6 leads to the upper end of the radiator tank.

Also proposed is one having the small-diameter pipe 1 firmly fixed to the cap body 8 at its central portion as shown in FIG. 15. More specifically, the small-diameter pipe 1 is secured to the central portion of the cap body 8, the valve retainer 23 having spring properties is provided with a vent hole 27, and a negative pressure/pressurization valve 29 is attached to the valve retainer 23, the negative pressure/pressurization valve 29 having a negative pressure opening/closing slot 28.

In the above former and latter, their pressurization valves are both seated on the valve seat 3 of the filler neck 6. There was also a need to form the notches 21 and the cam face 20 on the flanged portion 19 of the filler neck 6. This necessitated a multiplicity of dies and fabrication steps for forming the filler neck 6, and a high precision finish. As a result, the manufacturing costs of the filler neck 6 tended to rise.

SUMMARY OF THE INVENTION

It is therefore the object of the present invention to provide a cap with pressure valve, including a filler neck 6, at low costs by simplifying the shape of the filler neck 6 and eliminating the need for a high molding precision.

In order to achieve the above object, according to an aspect of the present invention there is provided a radiator cap with pressure valve comprising a cap body, the cap body including an upper member in the form of an upper lid having at its upper end a small-diameter pipe for guiding cooling water; a cylindrical lower member separate from the upper member, the lower member having at its lower end inner periphery a valve seat in the form of an inner flange, the upper side of the lower member being secured to the upper member; and a sealing material mounted on the outer periphery of the lower member or the upper member to provide a liquidtight sealing between the lower member or the upper member and a filler neck disposed at the upper end of a radiator tank; a pressure valve internally mounted in the cap body so as to be pressed against the valve seat by way of a pressure spring; and a negative pressure valve positioned centrally of the pressure valve, wherein with the pressure valve internally mounted and the lower member firmly secured to the upper member, the cap body is inserted into the filler neck and fastened thereto in an anti-disengagement manner by use of locking means.

The locking means may comprise a hole formed in the outer periphery of the filler neck and a bolt or a pin inserted into the hole, where by the cap body is fastened to the filler neck in an anti-disengagement manner.

The locking means may comprise inverted-L-shaped locking grooves formed integrally on the outer periphery of the lower member of the cap body, the locking grooves extending axially from the lower edge of the lower member and circumferentially from the upper end of the lower member; and raised portions formed on the inner periphery of the filler neck at positions in registration with the locking grooves, the raised portions being guided along the inverted-L-shaped grooves so that the cap body is fastened to the filler neck in an anti-disengagement manner.

Preferably, the cap body is made of a synthetic resin molded part, and the filler neck is made of a cup-shaped metal plate whose lower end is open.

The cap body may be made of a synthetic resin molded part, and the filler neck may be made of a cup-shaped metal plate whose lower end is open, a pair of the raised portions being formed, by bending, on confronting inner peripheral surfaces of the cup.

BRIEF DESCRIPTION OF THE DRAWINGS

The above and other objects, aspects, features and advantages of the present invention will become more apparent from the following detailed description when taken in conjunction with the accompanying drawings, in which.

DESCRIPTION OF THE PREFERRED EMBODIMENTS

Embodiments of the present invention will now be described with reference to the drawings.

Figure 1:
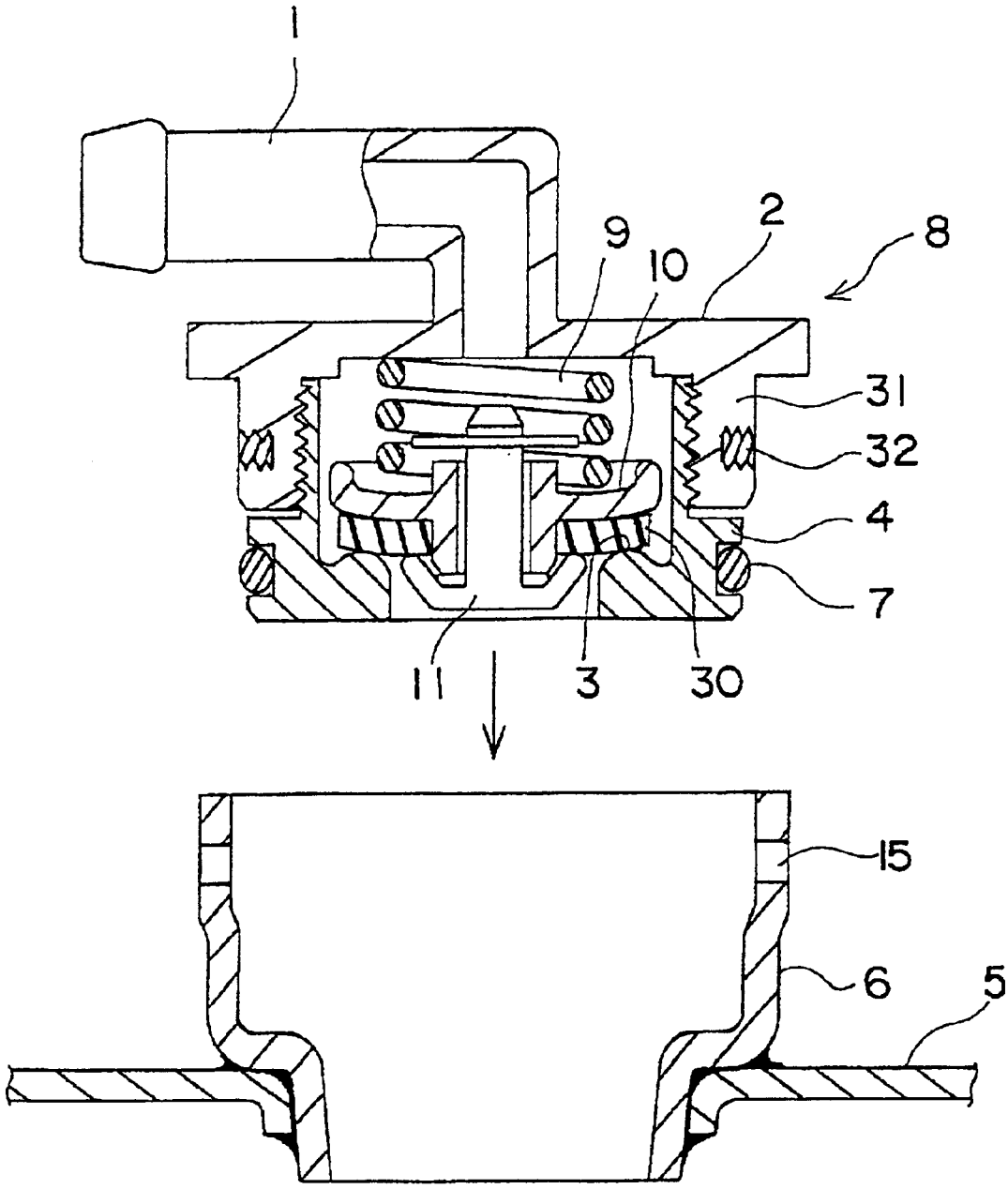
FIG. 1 is a longitudinal sectional view of a cap with pressure valve and a filler neck 6 mounted with the cap.
Figure 2:
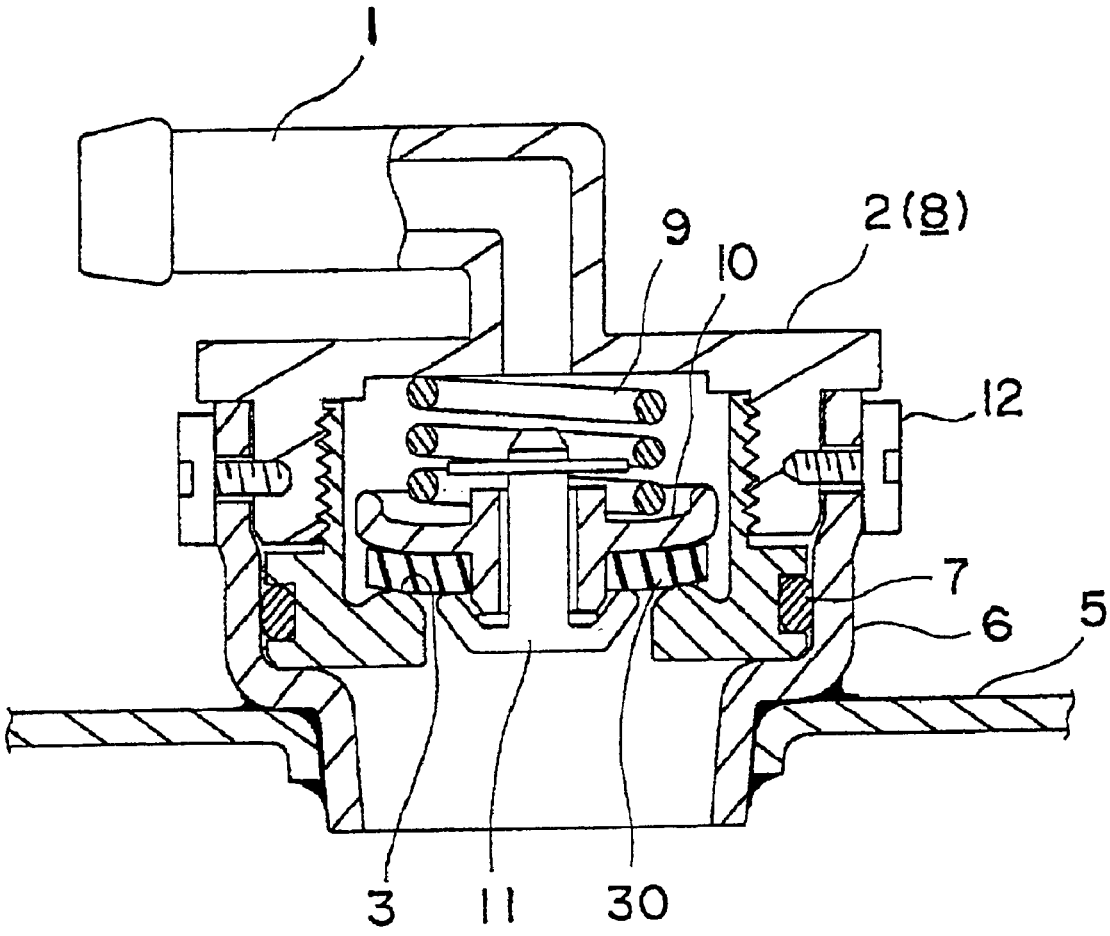
FIG. 2 is a longitudinal sectional view showing the state where the cap with pressure valve is mounted on the filler neck 6.

FIG. 1 is a longitudinal sectional view of a cap body 8 and a filler neck 6, showing a first embodiment of the present invention. FIG. 2 shows the state of mounting thereof.

The cap body 8 comprises an upper member 2 and a lower member 4 which are each made of a synthetic resin injection-molded part, a pressurization valve 10 and a negative pressure valve 11. The upper member 2 is in the form of an upper lid which includes a small-diameter pipe 1 for cooling water guidance extending integrally centrally from the upper end, and a short tubular potion 31 extending from the underside of the upper member 2, with a pair of threaded blind holes 32 formed in the outer periphery of the tubular portion 31.

The lower member 4 is formed as a cylinder separate from the upper member 2 and includes a valve seat 3 in the shape of an inner flange extending along its lower end inner periphery, with its upper end outer periphery being secured to the inner periphery of the upper member 2 by screwing or other means. The lower end outer periphery of the lower member 4 is formed with an annular groove for receiving a sealing material 7.

The pressurization valve 10 is formed like a dish having at its center a hole for receiving the shank of the negative pressure valve 11, the pressurization valve 10 being urged downward by a pressure spring 9. A rubber plate 30 is provided facing the underside of the pressurization valve 10 such that the pressurization valve 10 is seated on the valve seat 3 by way of the rubber plate 30. The negative pressure valve 11 via its edge is also seated on the rubber plate 30.

The filler neck 6 is formed by drawing a metal plate in this example. The filler neck 6 is in the shape of a shouldered cylinder with its small-diameter portion being inserted into the upper end opening of a radiator tank 5 such that its inserting portion is brazed in a liquidtight fashion. The filler neck 6 has at its upper end a hole 15 positioned in registration with the threaded hole 32 of the upper member 2.

The cap body 8 is fitted to such a filler neck 6 as shown in FIG. 2, with a bolt 12 inserted into the hole 15 and the threaded hole 32 for being screwed such that the cap body 8 can be fastened to the filler neck 6 so as to prevent the former from being disengaged from the latter. At that time, the sealing material 7 provides a liquidtightness between the cap body 8 and the filler neck 6. A hose not shown is connected, at its one end, to the extremity of the small-diameter pipe 1 and, at its other end, to a surge tank not shown.

When the engine is actuated, the temperature of the cooling water rises and the internal pressure of the radiator tank 5 increases so that the negative pressure valve 11 is thrust up and seated on the rubber plate 30. When the internal pressure of the radiator tank 5 further goes up and reaches a predetermined level, the pressurization valve 10 is thrust up against the pressure spring 9 so that the steam and cooling water within the radiator tank 5 is introduced via the small-diameter pipe 1 into the surge tank not shown. When the engine comes to a stop, the temperature of the cooling water lowers and the internal pressure of the radiator tank 5 goes negative, with the result that the negative pressure valve 11 is pressed down so that the cooling water within the surge tank not shown is introduced via the small-diameter pipe 1 into the radiator tank 5.

Figure 3:
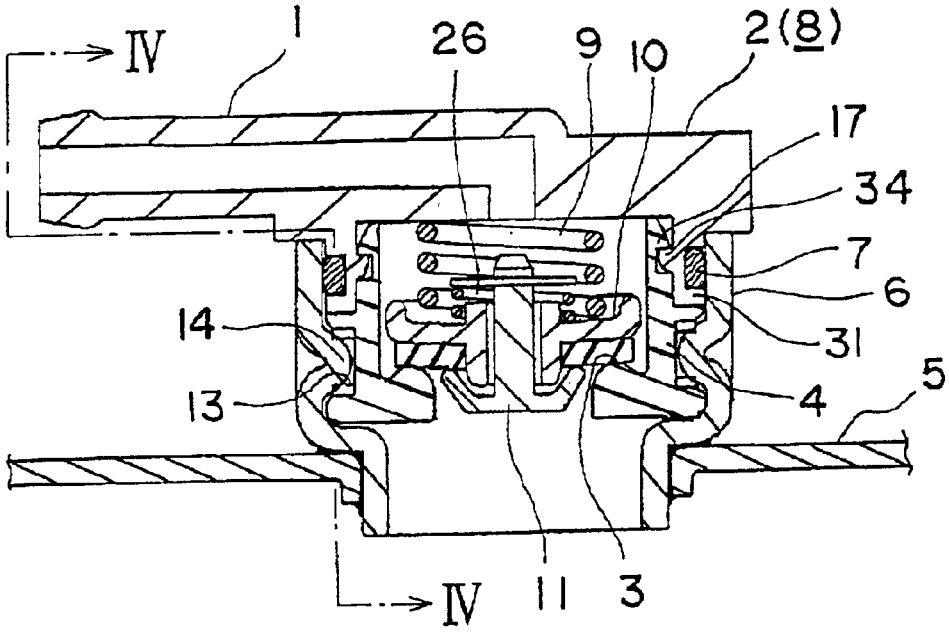
FIG. 3 is a longitudinal sectional view of a cap with pressure valve in accordance with a second embodiment of the present invention.
Figure 4:
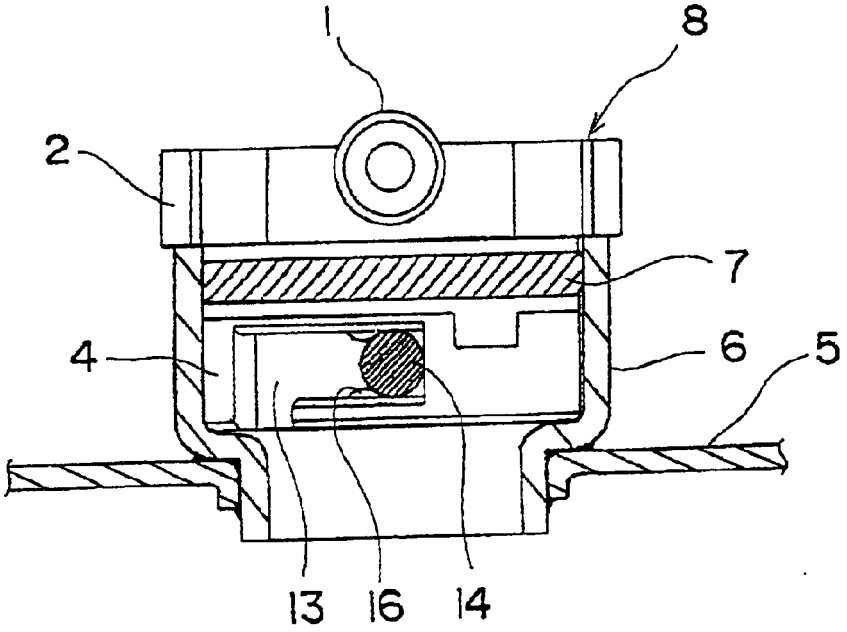
FIG. 4 is a sectional view taken along a line IV—IV of FIG. 3.
Figure 5:
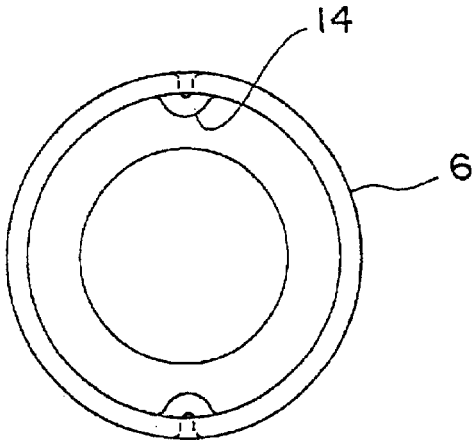
FIG. 5 is a top plan view of the filler neck 6 of the cap with pressure valve.
Figure 6:
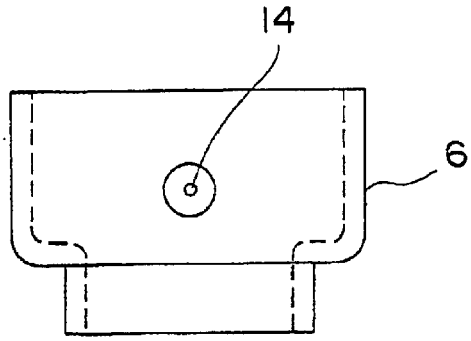
FIG. 6 is a front elevational view of the filler neck 6 of the cap.
Figure 7:
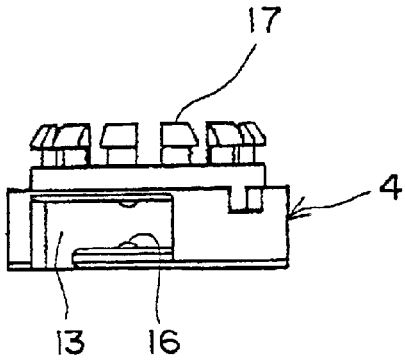
FIG. 7 is a front elevational view of a lower member 4 of the cap with pressure valve.
Figure 8:
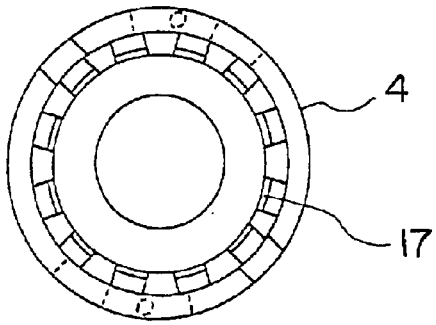
FIG. 8 is a top plan view of the lower member 4 of the cap.
Figure 9:
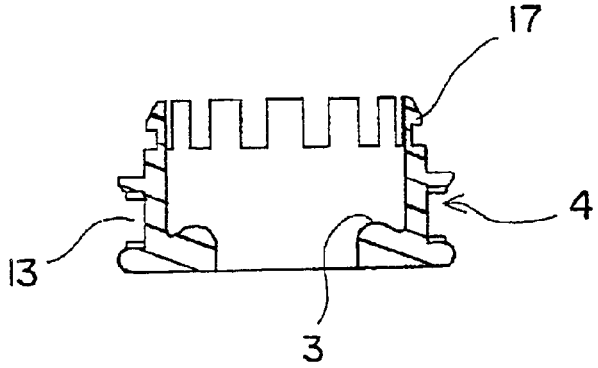
FIG. 9 is a longitudinal sectional view of the lower member 4 of the cap.
Figure 10:
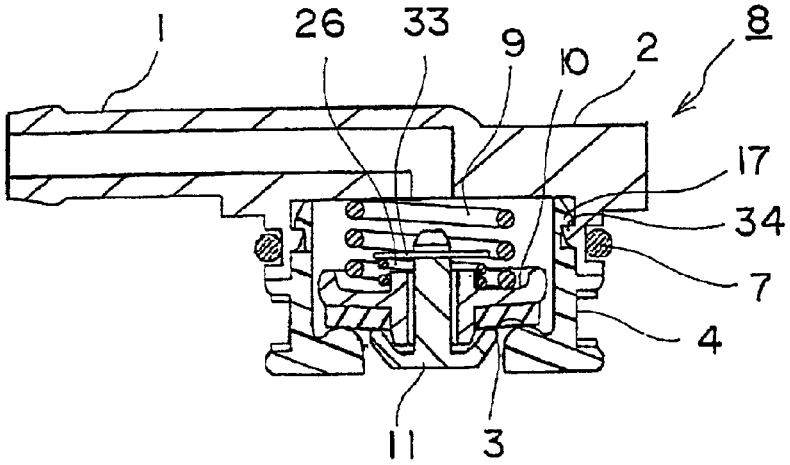
FIG. 10 is a longitudinal sectional view of the cap with pressure valve.
Figure 11:
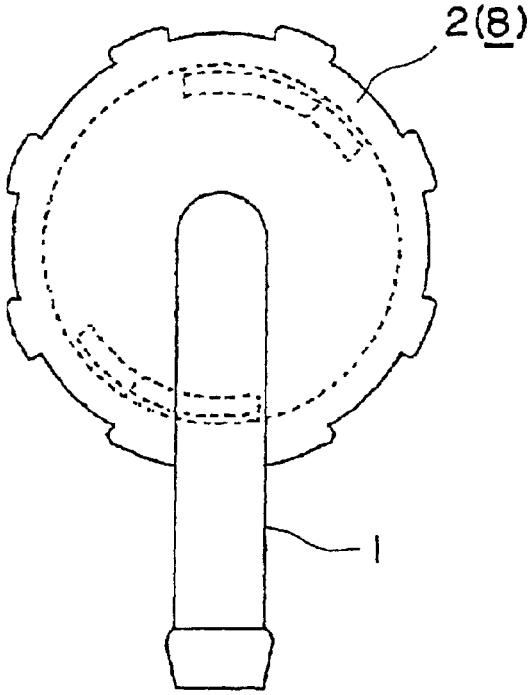
FIG. 11 is a top plan view of the cap with pressure valve.
Figure 12:
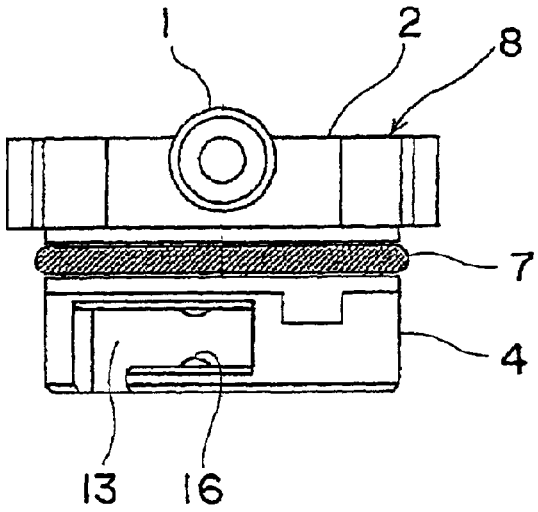
FIG. 12 is a front elevational view of the cap with pressure valve.
Figure 13:
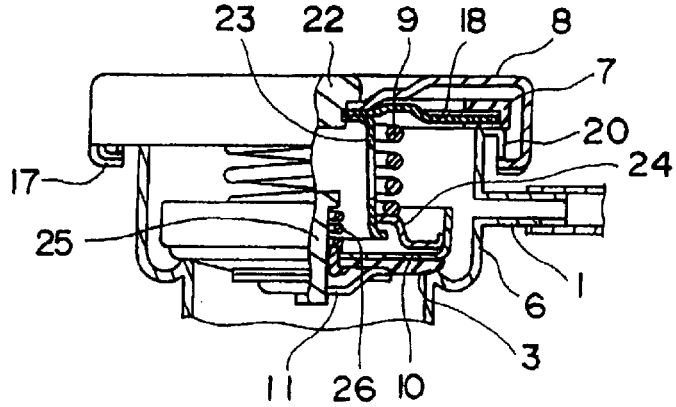
FIG. 13 PRIOR ART
FIG. 13 is a fragmentary longitudinal sectional view of a cap with pressure valve of a conventional radiator.
Figure 14:
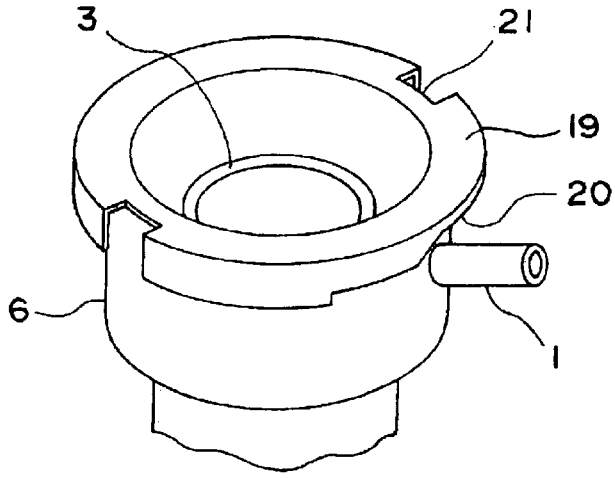
FIG. 14 PRIOR ART
FIG. 14 is a schematic perspective view of a filler neck 6 mounted with the cap.
Figure 15:
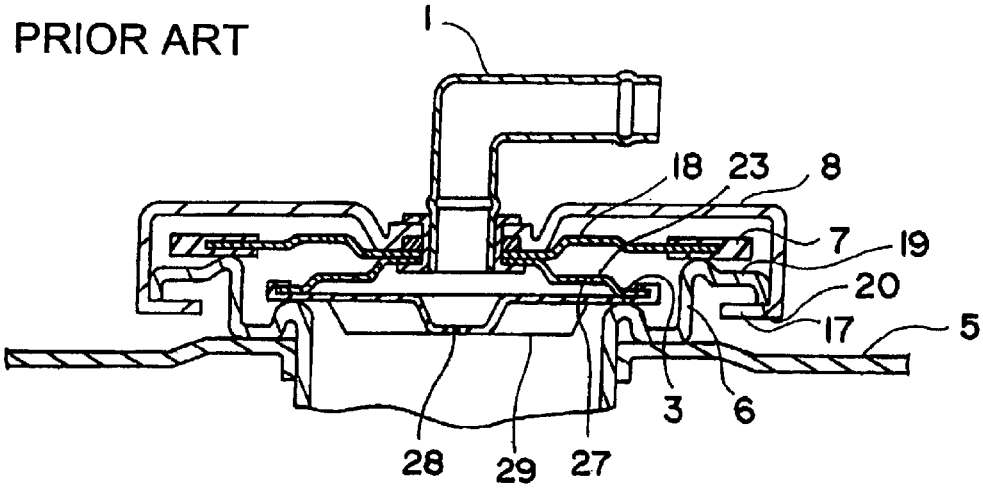
FIG. 15 PRIOR ART
FIG. 15 is a longitudinal sectional view showing another example of the cap with pressure valve of the conventional radiator.

FIG. 3 is a longitudinal sectional view showing a second embodiment of the present invention and FIG. 4 is a sectional view taken along a line IV—IV of FIG. 3. FIG. 5 is a top plan view of the filler neck 6; FIG. 6 is a front elevational view of the same; FIG. 7 is a front elevational view of the lower member 4 which is a constituent element of the cap body 8; FIG. 8 is a top plan view of the same; FIG. 9 is a longitudinal sectional view of the same; FIG. 10 is a longitudinal sectional view showing the state of assembly of the cap body 8; FIG. 11 is a top plan view of the same; and FIG. 12 is a front elevational view of the same.

This embodiment differs from the first embodiment in that the upper member 2 has on its outer peripheral side the groove for receiving the sealing material 7 and that the lower member 4 has at its upper end a multiplicity of locking claws 17, with engaging portions 34 in registration therewith formed in the inner surface of the tubular portion 31 of the upper member 2.

The outer periphery of the lower member 4 is formed with a pair of locking grooves 13 shown in FIG. 4 which extend in an inverted-L shape for receiving a pair of raised portions 14 of the filler neck 6. The filler neck 6 as shown in FIGS. 5 and 6 has the pair of protuberances 14 which are inwardly bent and diametrically opposed to each other.

The pair of locking grooves 13 of the lower member 4 as shown in FIG. 7 are provided with a pair of vertically confronting ridges 16 positioned in vicinity of abutments of the locking grooves 13. The pair of raised portions 14 of the filler neck 6 are seated between the ridges 16 and the abutments of the locking grooves 13. The multiplicity of locking claws 17 are formed at the upper end of the lower member 4.

The thus constructed cap with pressure valve is assembled by way of example as follows. The shank of the negative pressure valve 11 is inserted into the central hole of the pressurization valve 10, with a negative pressure spring 26 fitted to the outer periphery thereof, and a spring seat 33 (FIG. 10) is engaged with the shank upper end of the negative pressure valve 11. In such the state, the pressurization valve 10 is inserted into the lower member 4 such that the pressure spring 9 is seated on the pressurization valve 10. Then, the upper member 2 mounted with the sealing material 7 is press fitted to the upper end of the lower member 4. As a result, the locking claws 17 of the lower member 4 are resiliently deformed toward the center and then restored so that the locking claws 17 come into engagement with the engaging portions 34 of the upper member 2 for the prevention of disengagement.

Such a cap with pressure valve allows the lower ends of the locking grooves 13 to register with the raised portions 14 of the filler neck 6 for being pressed downward. It is then circumferentially turned and positioned so that the raised portions 14 climb over the ridges 16 for abutment against the ends of the locking grooves 13. The mounting of the cap is thus completed.

In this example as well, the upper member 2, the lower member 4, the negative pressure valve 11 and the pressurization valve 10 are each made of a plastic molded part, and the filler neck 6 and the radiator tank 5 are each made of a metal plate.

According to the present invention as defined in claim 1, the pressure valve including the valve seat 3 are provided on the cap body 8 side so that the filler neck 6 does not need a high-accuracy valve seat. This eliminates any variances in the valve opening pressure and provides a cap with pressure valve having a high reliability. This also makes possible to simplify the shape of the filler neck 6 and to improve the mass productivity of the radiator itself.

According to the present invention as defined in claim 2, the cap body 8 having the pressure valve including the valve seat 3 is locked with the filler neck 6 by use of the locking means such as the bolt 12 for the prevention of disengagement, whereby when the interior of the radiator tank 5 is at a high temperature, it is prevented to inadvertently open the cap body 8 to allow the heated water to be ejected, thus providing a cap with pressure valve having a simple structure and a high safety.

According to the present invention as defined in claim 3, the inverted-L shaped locking grooves 13 are integrally formed on the outer periphery of the lower member 4 of the cap body 8, with the raised portions 14 formed on the inner periphery of the filler neck 6 at positions in registration with the locking grooves 13 so that the cap body 8 can be fastened to the filler neck 6 in an anti-disengagement manner by use of locking means which include the raised portions 14 guided along the inverted-L shaped locking grooves 13. A cap with pressure valve having good mounting properties is thus provided.

While illustrative and presently preferred embodiments of the present invention have been described in detail herein, it is to be understood that the inventive concepts may be otherwise variously embodied and employed and that the appended claims are intended to be construed to include such variations except insofar as limited by the prior art.

What is claimed is:

1. A radiator cap with pressure valve comprising:

a cap body, said cap body including:

an upper member in the form of an upper lid having at its upper end a small-diameter pipe for guiding cooling water;

a cylindrical lower member separate from said upper member, said lower member having at its lower end inner periphery a valve seat in the form of an inner flange, the upper side of said lower member being secured to said upper member; and a sealing material mounted on the outer periphery of said lower member or said upper member to provide a liquid tight sealing between said lower member or said upper member and a filler neck disposed at the upper end of a radiator tank;

a pressurization valve internally mounted in said cap body so as to be pressed against said valve seat by way of a pressure spring; and a negative pressure valve positioned centrally of said pressure valve, wherein with said pressurization valve internally mounted and said lower member firmly secured to said upper member, said cap body is inserted into said filler neck and fastened thereto in an anti-disengagement manner by use of locking means; and said locking means comprising:

inverted-L-shaped locking grooves formed integrally on the outer periphery of said lower member of said cap body, said locking grooves extending axially from the lower edge of said lower member and circumferentially from the upper end of said lower member; and raised portions formed on the inner periphery of said filler neck at positions in registration with said locking grooves, said raised portions being guided along said inverted-L-shaped grooves so that said cap body is fastened to said filler neck in an anti-disengagement manner.

2. A radiator cap with pressure valve comprising:

a cap body, said cap body including:

an upper member in the form of an upper lid having at its upper end a small-diameter pipe for guiding cooling water;

a cylindrical lower member separate from said upper member, said lower member having at its lower end inner periphery a valve seat in the form of an inner flange, the upper side of said lower member being secured to said upper member; and a sealing material mounted on the outer periphery of said lower member or said upper member to provide a liquid tight sealing between said lower member or said upper member and a filler neck disposed at the upper end of a radiator tank;

a pressurization valve internally mounted in said cap body so as to be pressed against said valve seat by way of a pressure spring; and a negative pressure valve positioned centrally of said pressure valve, wherein with said pressurization valve internally mounted and said lower member firmly secured to said upper member, said can body is inserted into said filler neck and fastened thereto in an anti-disengagement manner by use of locking means; and said locking means comprising:

inverted-L-shaped locking grooves formed integrally on the outer periphery of said lower member of said cap body, said locking grooves extending axially from the lower edge of said lower member and circumferentially from the upper end of said lower member; and raised portions formed on the inner periphery of said filler neck at positions in registration with said locking grooves, said raised portions being guided along said inverted-L-shaped grooves so that said cap body is fastened to said filler neck in an anti-disengagement manner; and wherein said upper and lower members of said cap body are formed of synthetic resin, and wherein said filler neck is made of a cup-shaped metal plate whose lower end is open, a pair of said raised portions being formed, by bending, on confronting inner peripheral surfaces of said cup.

* * * * *